United States Patent [19]

Muellner

[11] 3,978,959

[45] Sept. 7, 1976

[54] DISPENSING SYSTEM FOR WHEELED VEHICLES

[75] Inventor: James M. Muellner, White Bear Lake, Minn.

[73] Assignee: Smarte Carte, Inc., White Bear Lake, Minn.

[22] Filed: June 7, 1974

[21] Appl. No.: 477,492

Related U.S. Application Data

[63] Continuation of Ser. No. 380,822, July 19, 1973, abandoned.

[52] U.S. Cl. ..... 194/4 R; 221/298

[51] Int. Cl.[2] ..... G07F 7/00

[58] Field of Search ..... 194/4; 221/289, 298, 221/295

[56] References Cited

UNITED STATES PATENTS

| | | | |
|---|---|---|---|
| 913,188 | 2/1909 | Backus | 194/4 |
| 2,818,955 | 1/1958 | Stackhouse | 194/4 |
| 3,165,189 | 1/1965 | Easterday | 194/4 |
| 3,194,377 | 7/1965 | Fischbach et al. | 194/4 |
| 3,754,630 | 8/1973 | Gilker | 194/4 |

*Primary Examiner*—Robert B. Reeves
*Assistant Examiner*—Francis J. Bartuska
*Attorney, Agent, or Firm*—Merchant, Gould, Smith, Edell, Walter & Schmidt

[57] ABSTRACT

An improved, simply operable, self-servicing vending system for wheeled vehicles, particularly of the hand-operated cart-type. A vending island is designed to guide and retainably hold a plurality of wheeled carts in consecutive alignment. The vending island includes a platform for holding the carts having vehicle handling receiving and dispensing terminals. Carts are irremovably accepted to the platform at the receiving terminal by a receiver apparatus that is positioned to engage and controllably guide in the receiving direction a support wheel of the cart being received. The receiver apparatus enables a coin refund unit to eject therefrom a predetermined monetary amount upon complete acceptance of the cart by the receiver apparatus to the platform. Carts are dispensed from the platform at the dispensing terminal by a dispenser apparatus. The dispenser apparatus operatively engages a support wheel of the foremost retained cart on the platform and enables the support wheels thereof to be released from retainment by the platform upon receipt of an activation signal by a monetary actuated control unit. The control unit provides the activation signal upon its receipt in escrow of a predetermined monetary amount. Built-in theft protection prevents multiple dispensing and multiple coin refunds on any single dispensing and receiving cycles respectively.

10 Claims, 12 Drawing Figures

FIG. 1
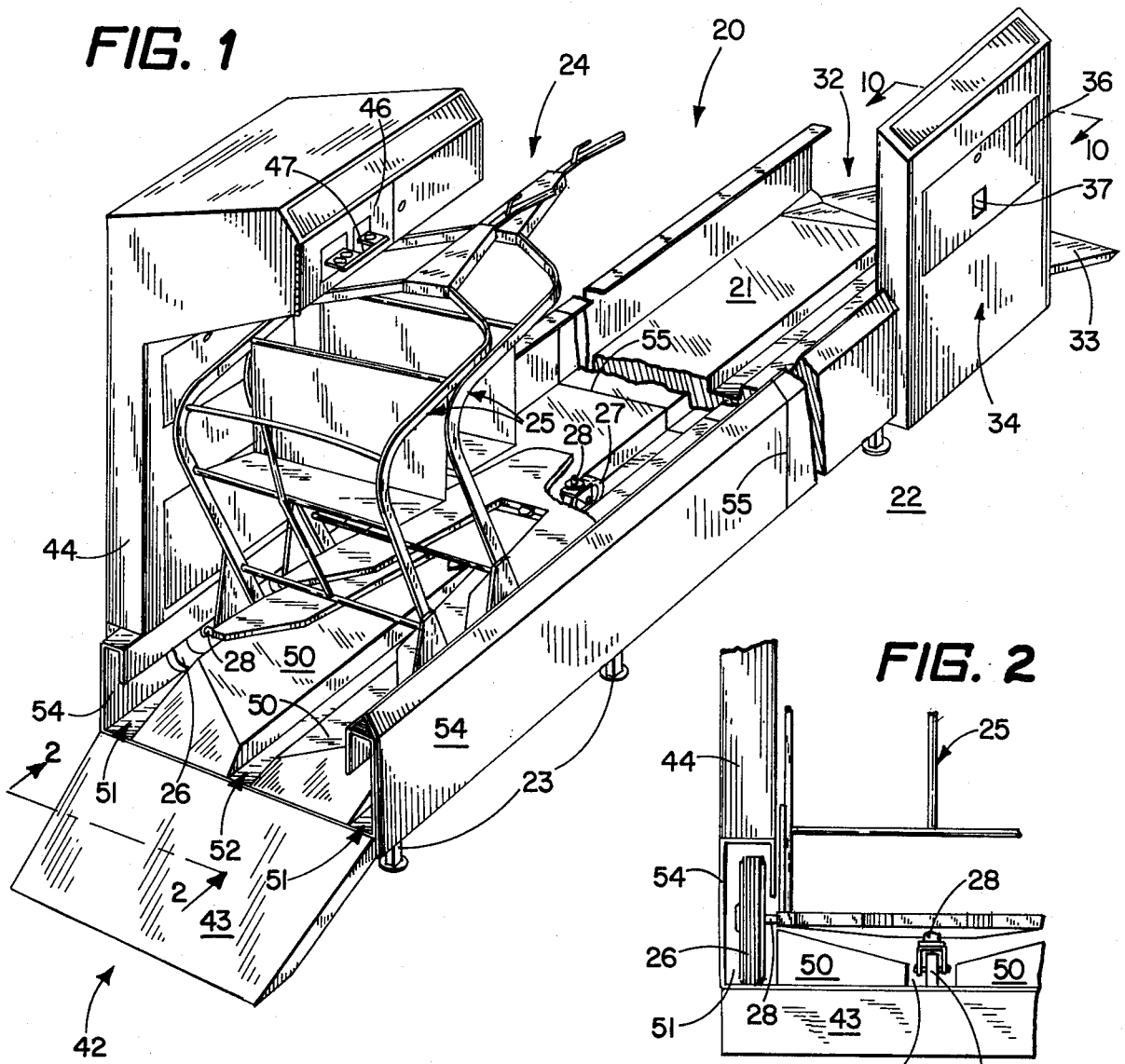
FIG. 2
FIG. 6
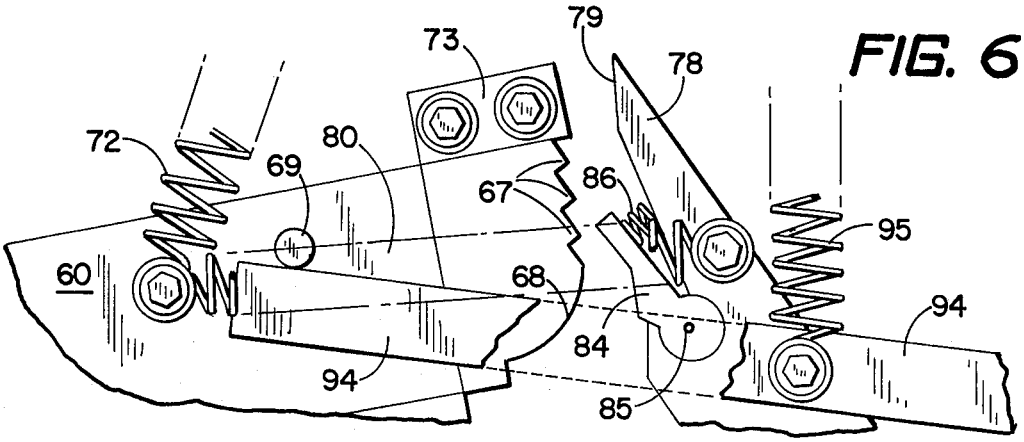

DISPENSING SYSTEM FOR WHEELED VEHICLES

This is a continuation of application Ser. No. 380,822, filed July 19, 1973, now abandoned.

BACKGROUND OF THE INVENTION

1. Field of the Invention

This invention relates generally to dispensing systems and more specifically to a dispensing system for wheeled carts and the like.

2. Description of the Prior Art

The availability of carts, strollers, and the like for public use has become an essential requirement in today's fast moving society. The modern sprawling shopping centers and passenger terminals exemplify two areas in which such a public service is an essential requirement. For example, modern passenger terminals are continually confronted with rising passenger loads requiring the rapid movement of passengers and baggage throughout the terminal. It is virtually impossible to satisfy such an increased demand with the standard "red cap" porter system. The resultant shuffle that normally ensues at a busy terminal during a typical day, not only results in unnecessary irritation, loss of time and cost to the passengers, but generates added confusion and inefficient movement throughout the terminal.

The availability of carts, strollers and the like for public use in such places of and by itself does not provide a solution to the problem. For example, in a busy passenger terminal loose carts may be found scattered throughout the terminal generally resulting in a less than adequate number of such carts at the locations where they are needed the most and in an excess number at those locations where they are of little use. Even if cart collection locations are specified throughout the terminal, a passenger in his haste will normally disregard these areas and will simply abandon his cart at random in the terminal. Besides its inherent inefficiency, such a practice creates peculiar liability problems and requires the employment of policing personnel for gathering and returning the carts to their designated areas.

In addition to the above problems, proprietors of shops within shopping centers may be confronted with additional cart distribution problems if they provide carts for use only within their shops. Individual shop proprietors must either police the use of carts they provide to insure that they do not leave their shop, or must police the entire shopping center to return carts that have been improperly removed.

The above problems are nearly eliminated by an automatic self-service cart vending system which provides a cash refund upon the return of a cart to a vending island. The refund system makes the carts self-policing, thus minimizing the need for special cart collecting and handling employees. By strategically locating vending islands around a terminal or shopping center, such a system insures the availability of carts at locations where they are needed the most, while reducing liability problems associated with loose carts scattered at random about a premises.

Automatic self-service cart vending systems have been introduced in the prior art. Prior art cart-vending systems typically employed a rack having an elevated rail for supporting individual carts by casters appropriately located on the carts. The prior art systems required an individual who returned a cart to fold the cart and to lift it into a position that would allow the casters to engage the elevated rail. The systems also required a bulky housing enclosing the carts for preventing "cheating" of the system. The prior art systems did not generally meet with public acceptance. Further, such systems are not readily adaptable to varied cart configurations, since each cart would require specially placed casters thereon and would require size and weight limitations.

The novel automatic self-service cart vending system of the present invention overcomes the deficiencies of the prior art system. The self-service system of the present invention is simple to operate, includes built-in anti-theft protection, has a pleasing aesthetic appearance and has met with proven public acceptance. In addition, the self-service vending system of the present invention is readily adaptable to most types of wheeled cart and stroller vehicles.

While the present invention will be described in conjunction with its use in a luggage cart dispenser system for passenger terminals, it will be understood that the invention is not limited to this use, but is applicable to dispensing systems for any type of wheeled vehicles.

Further, while the present invention is described with reference to specific embodiments of dispensing and receiving control apparatus operating upon and in response to a support wheel of a cart, it will be understood that the invention is not limited to the use of the particular apparatus illustrated, but, that any equivalent control apparatus which operates on and in response to movement of a support wheel of a vehicle may be used without departing from the spirit or intent of this invention.

Further, while the present invention employs receiving and dispensing apparatus which operate in response to diameter related parameters of a cart's support wheels, it will be understood that the invention would also apply to functionally equivalent dispensing and receiving apparatus which operate in response to width related parameters of such a cart's support wheels.

SUMMARY OF THE INVENTION

A platform supported in generally horizontal position with respect to the floor and having entrace and exit ramps operatively connecting its ends with the floor, has a plurality of races formed therein for holding a plurality of wheeled carts in consecutive alignment thereon. Wheel retaining members laterally extend the length of the platform and are positioned in cooperative alignment with the outer races. The retaining members prevent vertical or transverse motion of the retained cart support wheels that would tend to remove them from consecutive alignment on the platform other than at the ends of the platform.

That end of the platform adjacent the exit ramp, termed the dispensing terminal, includes a dispenser apparatus connected to controllably intercept a support wheel of the foremost cart adjacent the dispensing terminal. It its normal unactivated condition, the dispenser apparatus prevents the release of a cart from the platform by a release member which blocks movement of the intercepted support wheel toward the exit ramp. A monetary actuated control unit is operatively connected with the dispenser apparatus. The monetary actuated control unit activates the dispenser apparatus by unlatching the release member from its locked position when a predetermined monetary amount has been received in escrow by the control unit. An operator is thereby enabled to urge the cart support wheel through the dispenser apparatus and down the exit ramp, thus releasing the foremost cart from the vending system. Upon passing through the dispenser apparatus, the support wheel resets the dispenser apparatus for another vend by relatching the release member in its locked position. Theft prevention apparatus within the dispenser apparatus maintains the release member in its locked position following a normal vend sequence, thus preventing multiple vends of carts, until the monetary actuated control unit is recycled.

That end of the platform adjacent the entrance ramp, termed the receiving terminal, includes a receiver apparatus connected to controllably accept a support wheel of a cart received onto the platform. The receiver apparatus is aligned with an outer race and associated retaining member of the platform, such that a cart support wheel which successfully activates the receiver apparatus is retainably guided in consecutive alignment upon the platform and cannot thereafter be removed by means of the receiving terminal. A coin refund unit is operatively connected with the receiver apparatus and ejects a predetermined amount of change in response to a coin refund signal from the receiver apparatus. The receiver apparatus produces a coin refund signal after a cart support wheel passing therethrough has been irremovably received to the platform. In the preferred embodiment, the support wheel passing through the receiver apparatus operatively engages a series of levers which perform predetermined sequential operations culminating in a coin refund signal when the support wheel has passed completely through the receiver apparatus. A blocking member at the exit port of the receiver apparatus prevents a support wheel placed upon the platform to be pulled in the reverse direction through the receiver apparatus. The receiver apparatus includes built-in anti-theft protection which prevents the production of multiple coin refund signals in response to motion of a single support wheel through or within the receiver apparatus.

It is one object of the present invention, therefore, to provide an improved self-service cart vending system for wheeled vehicles. It is another object of the present invention to provide a self-service cart vending system which is simple to operate and will meet with public acceptance.

It is a further object of the present invention, therefore, to provide a self-service cart vending system which operates in response to movement of a support wheel of the vehicle held by the vending system.

It is another object of the present invention to provide a self-service cart vending system that is readily adaptable to accommodate standard types of self-service wheeled vehicles.

It is a further object of the present invention to provide a self-service cart vending system that incorporates built-in theft protection.

These and other objects of my invention will become apparent to those skilled in the art upon consideration of the accompanying specification, claims and drawings.

BRIEF DESCRIPTION OF THE DRAWINGS

FIG. 1 is a pictorial diagram of a preferred embodiment of a self-service cart vending system of the present invention;

FIG. 2 is a portion of a sectional view taken along the line 2—2 of the vending system illustrated in FIG. 1;

FIG. 6 is a diagrammatic representation detailing the pawl and ratchet portion of the dispenser apparatus disclosed in FIG. 3;

DESCRIPTION OF THE PREFERRED EMBODIMENT

Figure 3:
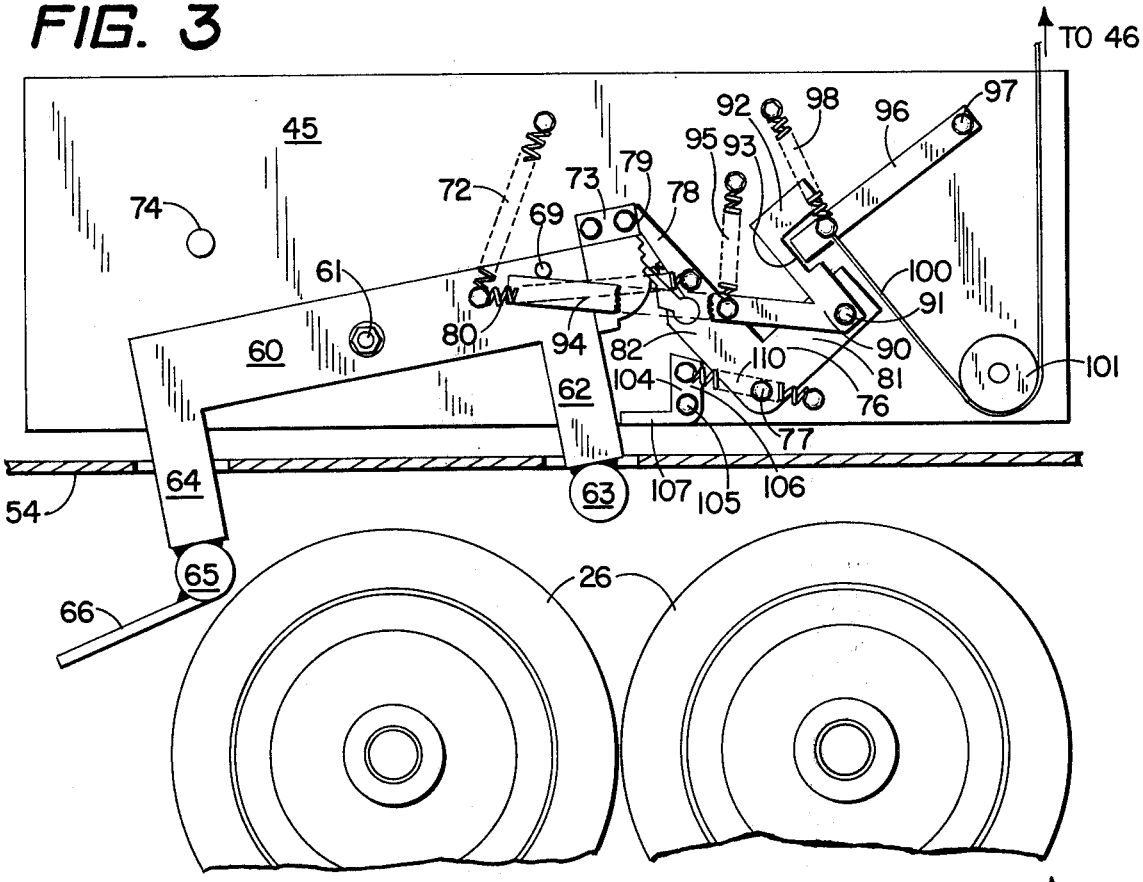
FIG. 3 is a diagrammatic representation of a preferred embodiment of the dispenser apparatus portion of the vending system disclosed in FIG. 1, illustrating a first relative positioning of its component parts.

Referring to the Figures, wherein like numerals represent like parts throughout the several views, the automatic cart vending island system of the preferred embodiment is generally illustrated at 20 in FIG. 1. The vending island 20 generally has an elongated raised platform 21 supported in generally horizontal relationship with a floor 22 by means of a plurality of support legs 23. Besides providing a pleasing aesthetic appearance to the system, the support legs 23 facilitate cleaning of the floor around and under the platform 21. The platform 21 is generally designed, as hereinafter described, to retainably support a plurality of wheeled vehicles generally designated at 24.

The particular vehicles 24 that are illustrated in FIG. 1 are baggage carts described in detail in the Design Patent No. D-206,116, issued to James R. Hughes, on Nov. 1, 1966. Another cart style that could equally well be employed in the system of the preferred embodiment is described in the copending design patent application of applicant James M. Muellner hereof, Serial No. 223,059, filed on Feb. 2, 1972 now U.S. Design Pat. No. D 230,142. In general, each of the carts 24 illustrated has a chassis 25 carried by means of a plurality of support wheels. The baggage carts 24 illustrated in FIG. 1 are three-wheeled vehicles each having a pair of axially aligned support wheels 26, each connected by means of an axle 28 to a forward part of the chassis 25, and having a third pivotal-type support wheel 27 connected by means of an axle 28 to a rear portion of the chassis 25. As illustrated, the support wheels 26 and 27 of the carts 24 normally engage the top surface of the platform 21 when situated thereon and normally engage the floor 22 when released from the vending island 20.

Two ends of the platform 21 are generally referred to as vehicle handling stations; the first of such ends being termed a receiving terminal 32, the other end being generally termed a dispensing terminal 42. An entrance ramp 33 upwardly sloping from the floor 22 to the receiving terminal 32 of the platform 21 enables the support wheels 26 and 27 of the carts 24 to roll in a continuous manner from the floor 22 to a resting position upon the platform 21. An exit ramp 43 downwardly sloping from the dispensing terminal 42 of the platform 21 to the floor 22 enables the support wheels 26 and 27 of the carts 24 to roll in a continuous manner from a resting position on the platform 21 to the floor 22.

A receiver apparatus 34, to be hereinafter described in more detail, is connected at the receiving terminal 32 and is positioned to engage one of the support wheels 26 of a cart 24 upon its acceptance to the platform 21. The receiver apparatus 34 has a coin refund unit operatively connected therewith and generally designated at 36. In the preferred embodiment, the receiver apparatus 34 and the coin refund unit 36 are physically housed in the same cabinet; however, as will become apparent herein, this particular positioning is not essential to the invention.

A dispenser apparatus 44, to be hereinafter described in more detail, is connected at the dispensing terminal 42 and is positioned to engage one of the support wheels 26 of a cart 24 upon its discharge from the platform 21. The dispenser apparatus 44 has a monetary actuated control unit operatively connected therewith and generally designated at 46. In the preferred embodiment, the dispenser apparatus 44 and the monetary actuated control unit 46 are physically housed in the same cabinet; however, as will become appparent herein, this particular positioning is not essential to the invention.

It will also be made clear upon a complete description of the preferred embodiment that although the monetary actuated control unit 46 and the coin refund unit 36 are illustrated as separate units, the principles of this invention would apply equally well to a single monetary control/refund unit embodying the operative principles of the two individual units. Further, the preferred embodiment as illustrated in FIG. 1, indiciates that the receiver apparatus 34 and the dispenser apparatus 44 operatively engage different ones of the support wheels 26 of a cart 24; it is to be understood that the invention is neither limited to the particular wheel engagement order illustrated, nor to the fact that the receiver and dispenser apparatus 34 and 44 respectively engage only one of the support wheels 26 of the carts 24.

Referring to FIGS. 1 and 2, the platform 21 has a pair of regularly defined raised portions 50 forming part of its upper surface, uniformly parallelly spaced and longitudinally extending the length of the platform 21 from its receiving terminal 32 to its dispensing terminal 42. The outwardly directed surfaces of the pair of raised portions 50 and the upper surfaces of the platform 21 extending laterally outward therefrom define a pair of outer races 51 longitudinally extending the length of the platform 21 and spaced to cooperatively accept and guide the axially aligned support wheels 26 of the carts 24. The inwardly directed surfaces of the pair of raised portions 50 of the platform 21 and the upper surface of the platform therebetween cooperatively define a third race 52 centrally positioned on the platform 21, and sized to cooperatively accept and guide the pivot wheels 27 of the carts 24 supported on the platform 21. A plurality of the carts 24, whose support wheels 26 and 27 are guidingly placed within the races 51 and 52 respectively consecutively align with one another upon the platform 21. The carts 24 of the preferred embodiment are designed to cooperatively "mesh" with one another when so aligned such that maximum packing density of those carts 24 guidingly positioned upon the platform 21 is achieved.

A pair of retaining members 54 are rigidly connected to the platform 21 and extend longitudinally therewith between its receiving and dispensing terminals 32 and 42 respectively. In the preferred embodiment, the foremost (FIG. 1) retaining member 54 comprises an inverted, generally U-shaped track, cooperatively positonally aligned above the foremost outer race 51. That portion of the rear retaining member 54 adjacent the dispensing apparatus 44 comprises an inverted, generally U-shaped track, while that part of the rear retaining member 54 that is not adjacent the dispensing apparatus 44 is of inverted L-shaped design. The inner spacing between the downwardly depending sides of each of the inverted U-shaped retaining members 54, is sized to freely accept the width of the support wheels 26 of the carts 24. The "bottoms" of the U-shaped and L-shaped retaining members 54 are vertically spaced from the outer races 51 with which they are aligned to enable unrestrained rolling movement of the support wheels 26 in the longitudinal direction therebetween, while preventing vertical and lateral movement of the support wheels 26 which would tend to remove them from the confines of the outer races 51. The outwardly directed downwardly depending sides of the retaining members 54 extend entirely down to the upper surface of the platform 21, closing the otherwise "open" sides of the pair of outer races 51. The inwardly directed sides of the U-shaped portions of the retaining members 54 downwardly depend to a vertical position just above the axles 28 of the support wheels 26 for enabling unrestricted longitudinal movement of the axles 28 as their associated support wheels 26 proceed down the outer races 51. The pair of retaining members 54 and the defining surface of the outer races 51, therefore, retainably enclose the axially aligned support wheels 26 of the carts 24 supported on the platform 21.

Those ends of the pair of raised portions 50 which terminate at the receiving and dispensing terminals 32 and 42 respectively, are beveled in the direction of their associated terminals to prevent scraping and binding of the lower chassis 25 of a cart 24 upon entering or leaving the vending island 20.

In the preferred embodiment, the platform 21 and its associated retaining members 54 are segmentable and may be alterably sized to hold 10 to 50 carts 24 depending on the anticipated use requirements of the system. The platform 21 and the retaining members 54 are segmentably connected at partition joints, generally designated at 55 in FIG. 1, for providing the variable cart holding capability.

It will be noted, that although the cart vending system of the preferred embodiment has a generally elongated shape, with separate receiving and dispensing terminals, the invention would also apply to curved or circular cart vending systems and to cart vending systems employing a single vehicle handling station for dispensing and receiving the carts. Further, while the preferred embodiment utilizes a raised platform for retainably holding the carts, a system which retainably holds a plurality of carts directly on the floor, and which otherwise bears the characteristics of this invention as described herein, is anticipated as within the scope and intent of this invention.

DISPENSER

Figure 4:
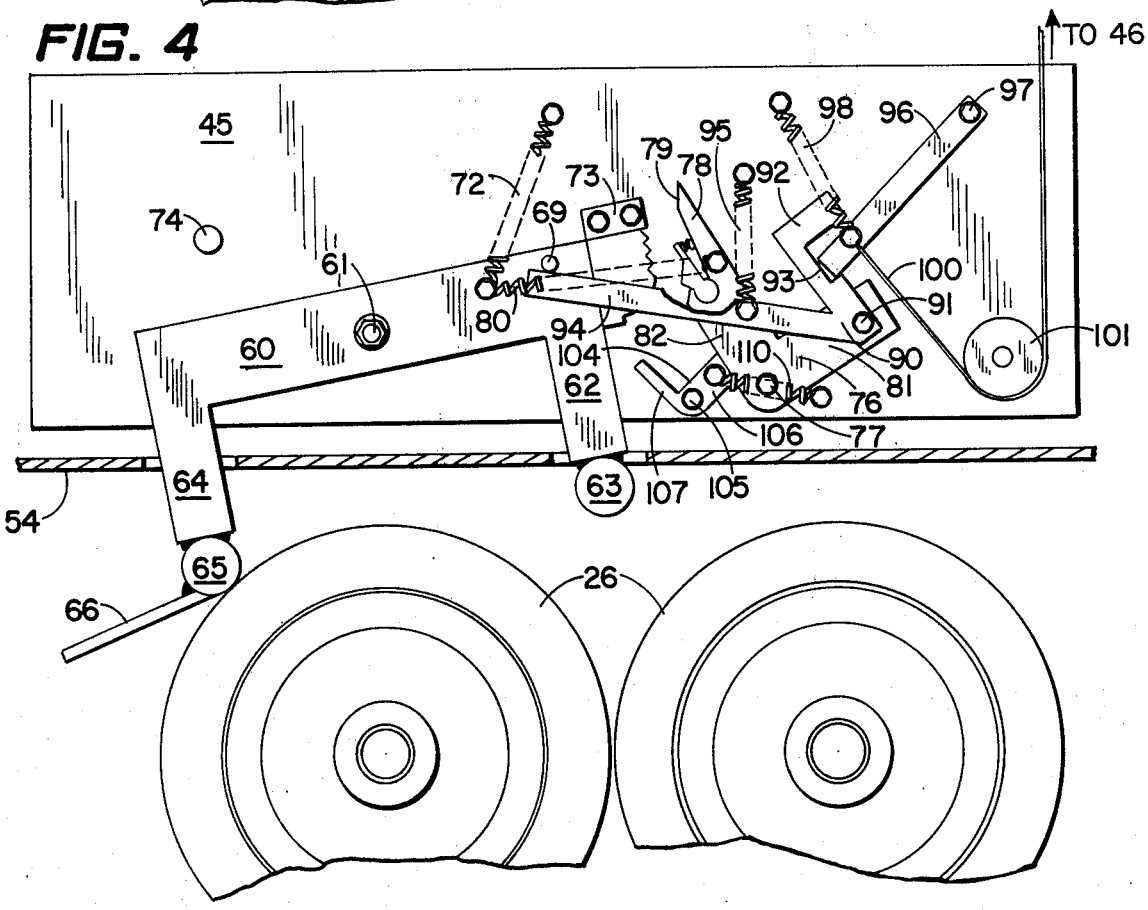
FIG. 4 is a diagrammatic representation of the dispenser apparatus disclosed in FIG. 3, illustrating a second relative positioning of its component parts.
Figure 5:
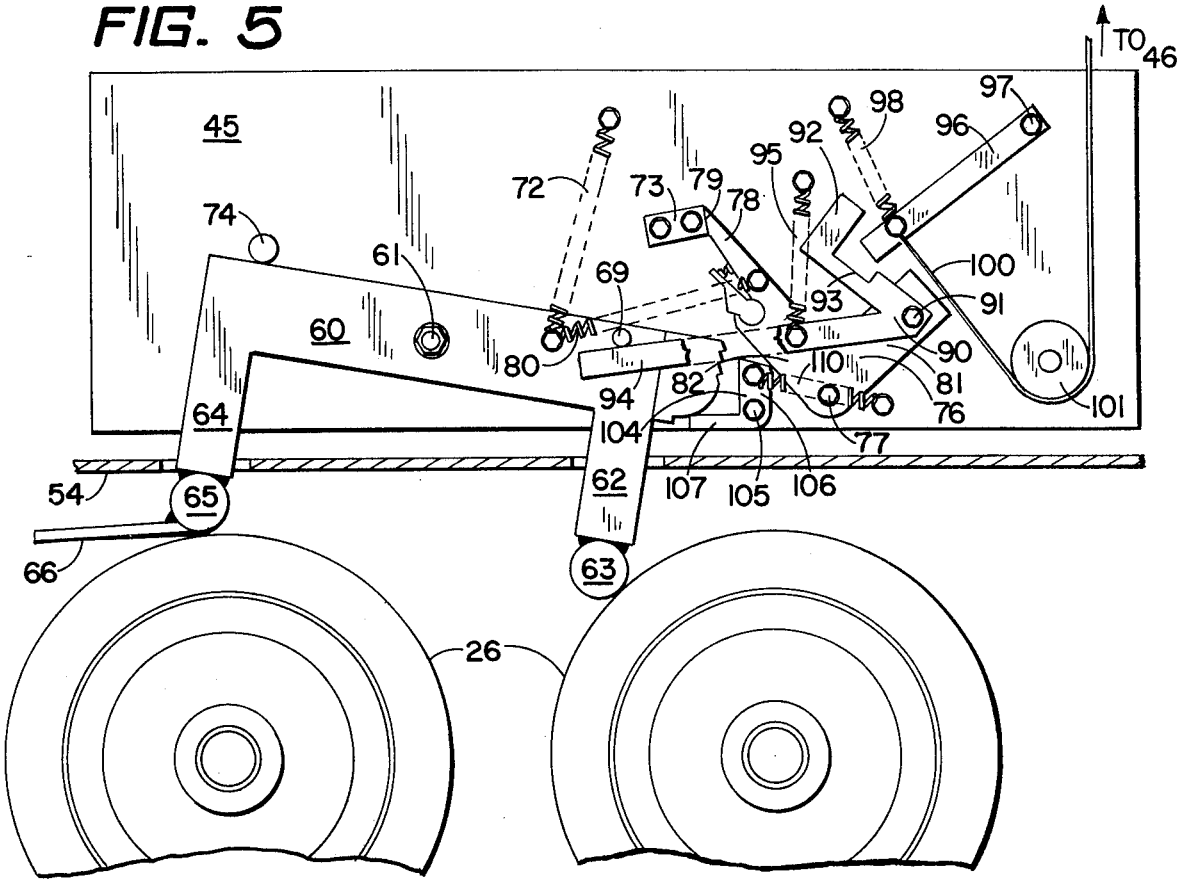
FIG. 5 is a diagrammatic representation of the dispenser apparatus disclosed in FIG. 3, illustrating a third relative positioning of its component parts.

A preferred embodiment of the dispenser apparatus 44 is illustrated in detail in FIGS. 3 through 6. The operative mechanism of the dispenser apparatus is diagrammatically illustrated as it would appear with the front panel of the dispenser apparatus 44 removed (see FIG. 1). The elements of the dispenser apparatus 44 are illustrated in FIG. 3 as they would relatively appear in a first controlling relationship with one another and with a support wheel 26 of a cart 24 to be dispensed from the vending island. FIGS. 4 and 5 illustrate the elements of the dispenser apparatus 44 in different relative positions corresponding to various operative points in time during a dispensing cycle.

Unless otherwise designated, all rigid and pivotal connections of the dispenser apparatus members are made to a dispenser housing 45. The dispenser housing 45 is generally situated above and is integrally connected to the inverted U-shaped portion of the retaining member 54 (see FIG. 1), such that a support wheel 26 being dispensed engages dispenser elements, as hereinafter described, connected to the housing 45 and extending through openings (FIGS. 3–5) provided therefor in the upper surface of the retaining member 54.

Referring to FIGS. 3–6, there is generally shown a release member 60 pivotally connected to the housing 45 at the pivot point 61. The release member 60 has a first downwardly depending arm 62 with a rod 63 welded to its lower terminus. The rod 63 extends laterally between the downwardly depending sides of the retaining member 54 to intercept a support wheel 26 as it proceeds in a dispensing direction down the outer race 51 to which the dispenser apparatus is cooperatively attached (see FIG. 1). The release member 60 further has a second downwardly depending arm 64 with a rod 65 welded to its lower terminus. The rod 65 has a plate 66 welded thereto. The rod 65 and the plate 66 extend laterally between the downwardly depending sides of the retaining member 54 to intercept a support wheel 26 as it proceeds in a dispensing direction down the outer race 51 and to prevent a support wheel 26 from re-entering the dispenser apparatus 44 once the wheel has been dispensed. When the release member 60 is positioned as illustrated in FIG. 3, the lower extremity of the plate 66 is vertically positioned above the bottom surface of the race 51 a distance that is significantly less than the collapsible diameter of a support wheel 26. The downwardly depending arms 62 and 64 of the release member 60 extend in generally vertical fashion through openings in the uppper surface of the retaining member 54.

The release member 60 further has a plurality of ratchet teeth 67 and a cylindrical surface 68 integrally formed in one end thereof (see FIG. 6). The release member 60 also has a stop rod 69 secured therein and laterally protruding therefrom.

A bias spring 72 is connected between the release member 60 and the housing 45, yieldingly urging the release member 60 toward movement in a counterclockwise direction about its pivot point 61 and toward resting engagement with a stop member 73 rigidly attached to the housing 45. A second stop member 74 is secured to the housing 45 and is positioned to engage the release member 60 for limiting its clockwise rotation about its pivot point 61.

A first actuator member 76 is pivotally connected to the housing 45 about a pivot point 77. The actuator member 76 has a first arm 78 terminating at a stop surface 79 configured to uniformly engage the stop member 73. The first arm 78 of the actuator member 76 is operatively connected to the release member 60 by means of a bias spring 80 yieldingly urging the first actuator member 76 toward counterclockwise rotation about its pivot point 77 such that the stop surface 79 of its first arm 78 is urged toward resting engagement with the stop member 73. The lower surface of the first arm 78 forms a latching surface 82.

The first actuator member 76 further has a second arm 81 generally extending at a right angle to the first arm 78.

A pawl 84 (see FIG. 6) is pivotally connected to the first arm 78 of the first actuator member 76 about a pivot point 85. The pawl 84 is positionally aligned to engage the plurality of ratchet teeth 67 of the release member 60 when the stop surface 79 of the arm 78 of the actuator member 76 is in resting engagement with the stop member 73. A bias spring 86 is connected between the pawl 84 and the arm 78 of the actuator member 76 yieldingly urging the pawl 84 toward counterclockwise rotation about its pivot point 85.

A second actuator member 90 is pivotally connected to the arm 81 of the first actuator member 76 at a pivot point 91. The second actuator member 90 has a first arm 92 having a notch 93 formed therein. The actuator member 90 further has a second arm 94 forming a generally acute angle with the first arm 92 about the pivot point 91. A bias spring 95 is connected between the housing 45 and the second arm 94, normally yieldingly urging the second actuator member 90 in clockwise rotation about its pivot point 91. The second arm 94 is sufficiently extended to engage, when rotated, the stop rod 69 protruding from the release member 60, thus limiting the clockwise rotation of the second actuator member 90 about its pivot point 91.

An actuator rod 96 is pivotally connected to the housing 45 at a pivot point 97. The movable end of the actuator rod 96 is positioned to engage the notch 93 in the first arm 92 of the second actuator member 90. A bias spring 98 is connected between the housing 45 and the actuator rod 96, normally yieldingly urging the actuator rod 96 in clockwise rotation about its pivot point 97.

One end of an actuator cable 100 is attached to the actuator rod 96. The actuator cable is guidingly directed by a pulley 101 to the monetary actuated control unit 46. The other end of the actuator cable 100 (not illustrated) is secured within the monetary actuated control unit 46 which exerts a controlled force upon the actuator rod 96 opposing that of the bias spring 98, urging the actuator rod 96 in counterclockwise rotation about its pivot point 97.

A trip lever 104 is pivotally connected to the housing 45 about a pivot point 105. The trip lever 104 has a first arm 106 and a second arm 107. The end of the first arm 106 is configured to uniformly engage the latching surface 82 of the second arm 81 of the first actuator member 76, under appropriate conditions as hereinafter described, and to prevent counterclockwise rotation of the actuator member 76 about its pivot point 77 when in such position. A bias spring 110 is connected between the housing 45 and the second arm 107 of the trip lever 104, normally yieldingly urging the trip lever 104 in clockwise rotation about its pivot point 105.

RECEIVER

Figure 7:
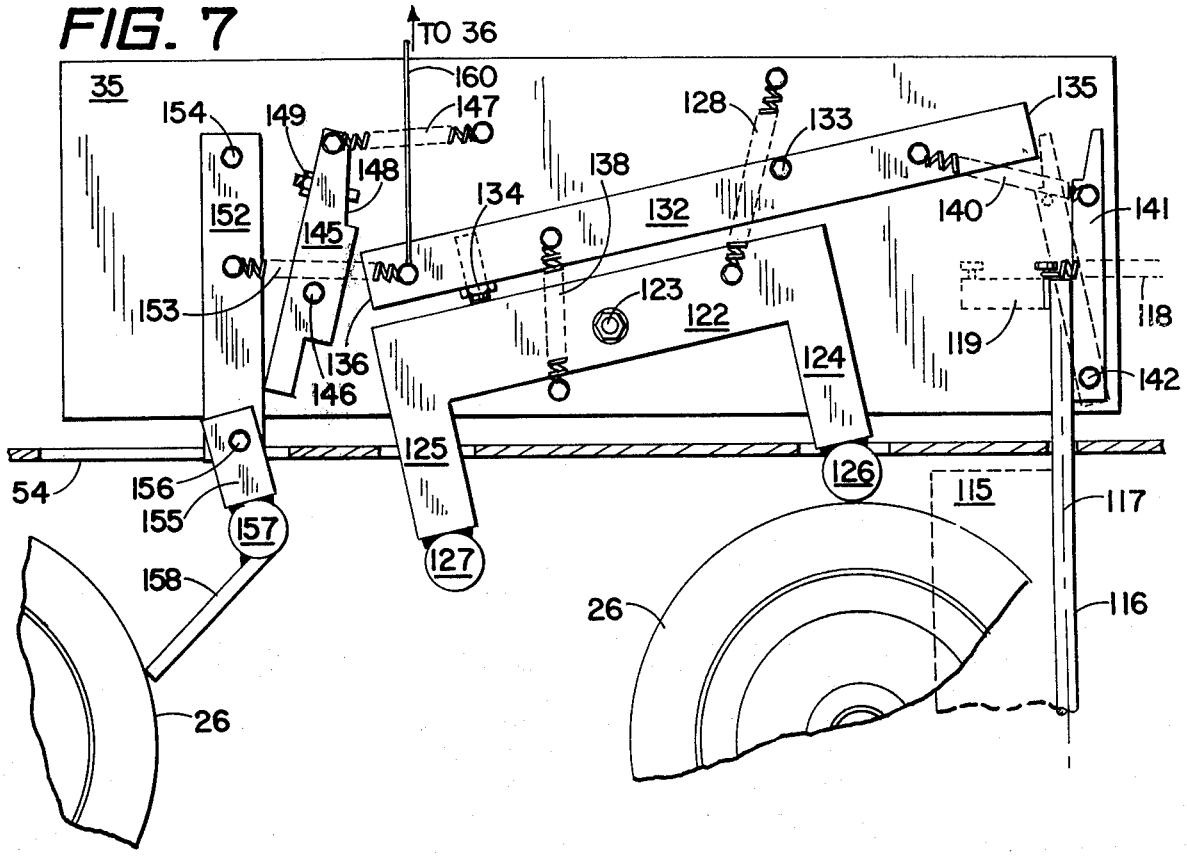
FIG. 7 is a diagrammatic representation of a preferred embodiment of the receiver apparatus portion of the vending system disclosed in FIG. 1, illustrating a first relative positioning of its component parts.
Figure 8:
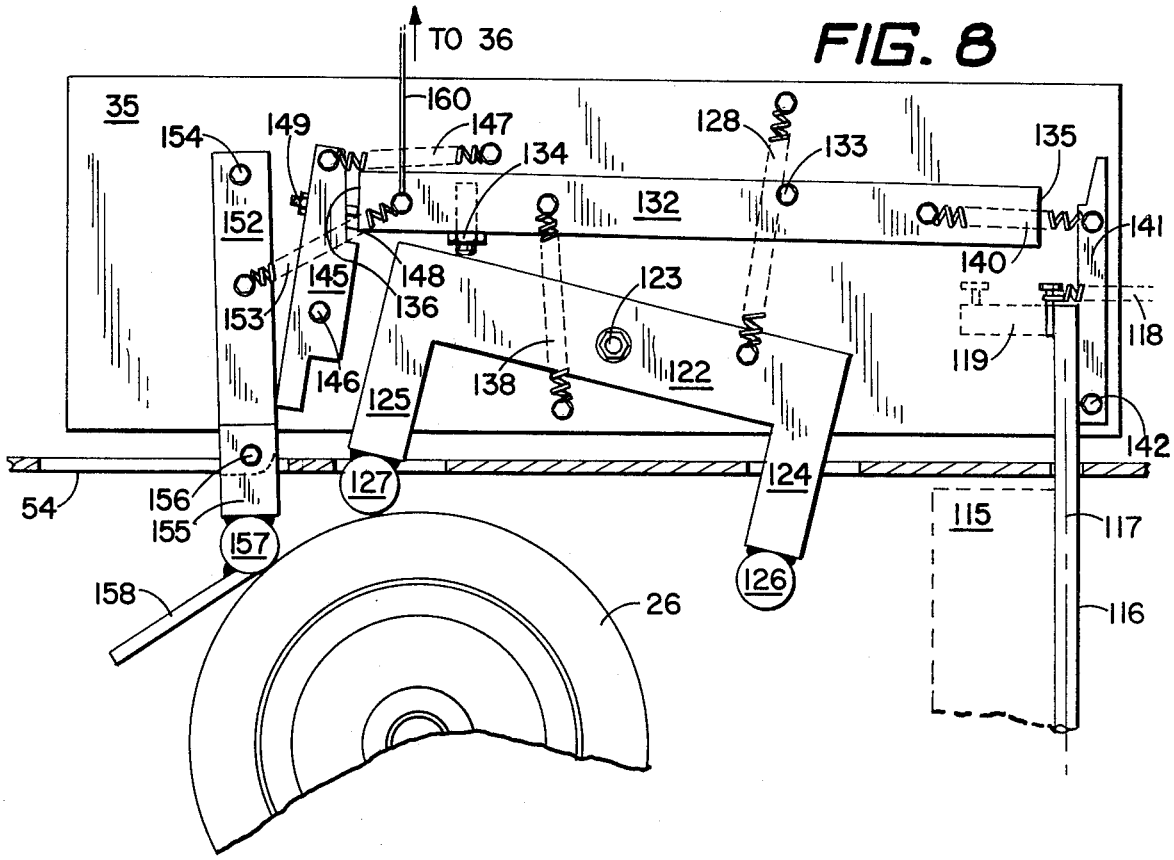
FIG. 8 is a diagrammatic representation of the receiver apparatus of FIG. 7, illustrating a second relative positioning of its component parts.
Figure 9:
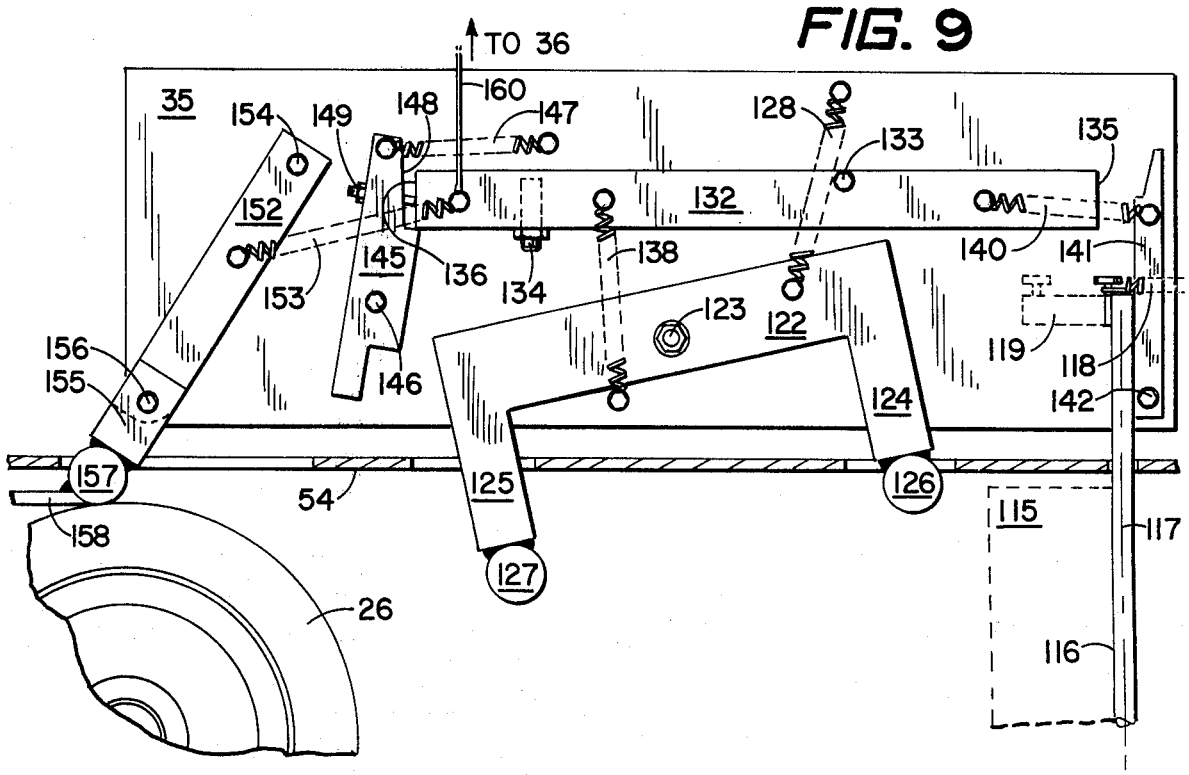
FIG. 9 is a diagrammatic representation of the receiver apparatus of FIG. 7, illustrating a third relative positioning of its component parts.

A preferred embodiment of the receiver apparatus 34 is illustrated in FIGS. 7–10. The preferred embodiment employs mechanically operative parts; however, other embodiments, hereinafter described, employ electromechanical operation. In the preferred embodiment the receiver apparatus 34 is generally positioned at the receiving terminal 32 of the platform 21 (FIG. 1) forming an integral part of and opening into the retaining member 54 situated in proximity with the forwardly located outer races 51 of the platform 21. FIG. 7 illustrates the mechanical elements of the receiver apparatus 34 as they would relatively appear in a first controlled relationship with respect to one another and with respect to a support wheel 26 of a cart 24 being received into the platform 21, if the front panel of the receiver apparatus (FIG. 1) were removed. FIGS. 8 and 9 illustrate the elements of the apparatus 34 in different relative positions corresponding to various operative points in time during a receiving cycle of a cart 24 onto the platform 21. Unless otherwise designated, the elements of the receiver apparatus 34 are connected to a receiver housing 35. The receiver housing 35 is generally situated above and is integrally connected to the inverted U-shaped retaining member 54 (see FIG. 1), such that a support wheel 26 being received engages receiver elements, as hereinafter described, connected to the housing 35 and extending through openings (FIGS. 7–9) provided therefor in the upper surface of the retaining member 54.

Figure 10:
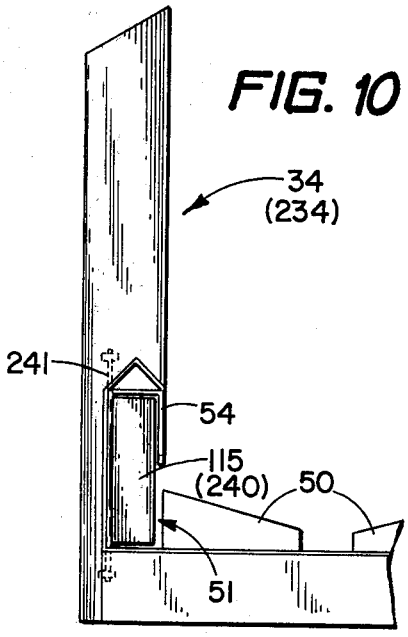
FIG. 10 is a partial sectional view taken along the line 10—10 of the vending system disclosed in FIG. 1.

Referring to FIGS. 7 and 10, there is generally shown a door member 115 connected to a shaft 116 connected to the housing 35 for rotation about a vertical axis 117. The door member 115 generally extends transversely across the opening defined by the retaining member 54 at the receiving terminal 32 (see FIG. 10) for accepting the support wheel 26 of a cart 24. The door 115 is closed as illustrated in full line in FIG. 7 in "end" view, and is illustrated by dashed lines therein as it would appear in an open position. A retaining member 119, generally coplanar with the door member 115, is also rigidly attached to the shaft 116 and is rotatable therewith about the axis 117. The door 115 and the retaining member 119 are normally held in their "closed" positions (with the door 115 yieldingly blocking the motion of a support wheel 26 in the receiving direction) by means of a bias spring 118 connected between the retaining member 119 and the housing 35. When viewed from a top elevation (not illustrated), the bias spring 118 would normally tend to urge the retaining member 119 and the door 115 in clockwise rotation about the axis 117.

An accepter member 122 is pivotally connected to the housing 35 at a pivot point 123. The accepter member 122 has a first downwardly depending arm 124 and a second downwardly depending arm 125 spaced from the first downwardly depending arm 124 by a distance somewhat less than the diameter of the support wheel 26 being received. A rod 126 is welded to the bottom terminus of the first downwardly depending arm 124. A rod 127 is welded to the bottom terminus of the downwardly depending arm 125. The rods 126 and 127 extend transversely across the path of a support wheel 26 when proceeding down the outer race 51 in the receiving direction. The downwardly depending arms 124 and 125 of the accepter member 122 extend in generally vertical fashion through openings in the upper surface of the retaining member 54.

A bias spring 128 is connected between the housing 35 and the accepter member 122, normally yieldingly urging the accepter member 122 in counterclockwise rotation about the pivot point 123.

A first actuator lever 132 is pivotally connected to the housing 35 at a pivot point 133. The first actuator lever 132 has a set screw 134 adjustably threaded into its lower surface and aligned to engage the upper surface of the accepter member 122. A bias spring 138 is connected between the housing 35 and the first actuator lever 132, normally yieldingly urging the first actuator member 132 in counterclockwise rotation about the pivot point 133, and urging the set screw 134 into engagement with the accepter member 122. The first actuator lever 132 further has a first and a second contact surface 135 and 136 respectively located at opposing ends thereof.

The first actuator lever 132 is further connected by means of a bias spring 140 to a latching lever 141. The latching lever 141 is pivotally connected to the housing 35 at a pivot point 142. The bias spring 140 normally yieldingly urges the latching lever 141 in counterclockwise rotation about the pivot point 142. The rotating end of the latching lever 141 is notched to cooperatively accept (as illustrated in dashed lines in FIG. 7) the first contact surface 135 of the first actuator lever 132.

A second actuator lever 145 is pivotally connected to the housing 35 at a pivot point 146. A bias spring 147 is connected between the second actuator lever 145 and the housing 35, normally yieldingly urging the second actuator lever in clockwise rotation about its pivot point 146. That side of the second actuator lever 145 facing the receiving terminal 32 has formed therein a notch 148 for slidably engaging and accepting the second contact surface 136 of the first actuator lever 132. A set screw 149 is threaded through the second actuator lever 145 and projects from the notch surface 148 for providing an adjustable variation on the effective "depth" of the notch 148 for engaging the second contact surface end 136 of the first actuator lever 132.

The first actuator lever 132 is also connected by means of a bias spring 153 to a third actuator lever 152. The third actuator lever 152 is pivotally connected to the housing 35 at the pivot point 154. The bias spring 153 normally yieldingly urges the third actuator lever 152 in counterclockwise direction about its pivot point 154. An extended member 155 is pivotally connected to the third actuator lever 152 at a pivot point 156. The extended member 155 has a rod 157 welded to its lower terminus, transversely extending across the patch of a support wheel 26 guidedly proceeding along the outer race 51. An extended plate 158 is welded to the rod 157 and transversely extends therewith across the outer race 51. The extended member 155 can be pivoted only in the counterclockwise direction with respect to a center line passing through the pivot points 154 and 156 of the third actuator lever 152. When rotated in a counterclockwise direction about the pivot point 156, the extended member 155 locks when aligned with the third actuator lever 152 to form a continuous extension of the third actuator lever 152 as illustrated in FIGS. 8 and 9. The lower extremity of the extended plate 158 is vertically positioned above the bottom surface of the race 51, a distance that is significantly less than the collapsible diameter of a support wheel 26.

One end of a coin refund actuator cable 160 is connected to that end of the actuator lever 132 nearest its second contact surface 136 and is movable therewith. The other end of the coin refund actuator cable is connected (not illustrated) within the coin refund unit 36 (see FIG. 1) for providing a coin refund signal thereto following a specific sequence of operations, as hereinafter described, by the receiver apparatus 34.

MONETARY CONTROL UNITS

The monetary actuated control unit 46 (FIG. 1) may comprise any type of mechanical, electromechanical or electrical monetary receiving unit (including a dollar-bill receptor unit) which functions to provide an appropriate output signal for activating the dispenser apparatus mechanism 44 upon receiving a predetermined monetary amount. In the preferred embodiment, that output signal required to activate the dispenser apparatus 44 is a retracting (or "pulling") force to be exerted upon the actuator cable 100 (FIG. 5) after acceptance by the monetary actuated control unit of the predetermined monetary amount. The monetary actuated control unit 46 illustrated in FIG. 1 is of the mechanically operative type requiring an operator to deposit three coins within the coin accepter lever 47, to push the coin accepter lever 47 into the monetary actuated control unit (thus depositing the coins in escrow therein) and to retract the coin accepter lever 47 back out of the monetary actuated control unit. Such coin accepter units are well known in the art and a discussion thereof will not be belaboured herein.

In the preferred embodiment, the actuator cable 100 is operatively engaged to the coin accepter lever 47. After the appropriate monetary amount has been received in escrow by the control unit 46, the retraction of the coin accepter lever 47 by an operator provides the required activation output signal energy to the actuator cable for activating the dispenser apparatus 44. A like result may be accomplished by means of an electrical or electromechanical monetary actuated control unit which could (for example) energize a solenoid or a small motor having a movable element or shaft respectively operatively connected to the actuator cable 100. In such systems, the electrically energized movable element would provide the required activation output signal to the dispenser apparatus 44 after receipt in escrow by the monetary actuated control unit of the required monetary amount. Other types of functionally equivalent monetary actuated control units could equally well be employed within the spirit and intent of this invention.

The coin refund unit 36 (FIG. 1) operatively connected with the receiver apparatus 34 may be of any standard construction, and selected for refunding the desired monetary amount in response to a predetermined refund input signal. In the preferred embodiment, that coin refund unit 36 employed is responsive to a mechanical refund signal represented by a sequential relaxation and exertion of tension upon the coin refund actuator cable 160 (FIG. 7) to refund a coin at the coin chute 37. When the alternate electromechanical embodiment of the receiver apparatus 234 is employed (as hereinafter described), that coin refund unit 36 selected refunds the predetermined monetary amount at the chute 37 in response to a monetary electrical pulse signal from the receiver apparatus 234. It is obvious that numerous variations and combinations of refund signals and coin refund units 36 could be employed in this system without departing from the spirit or intent of this invention.

RECEIVER — ALTERNATE

Figure 11:
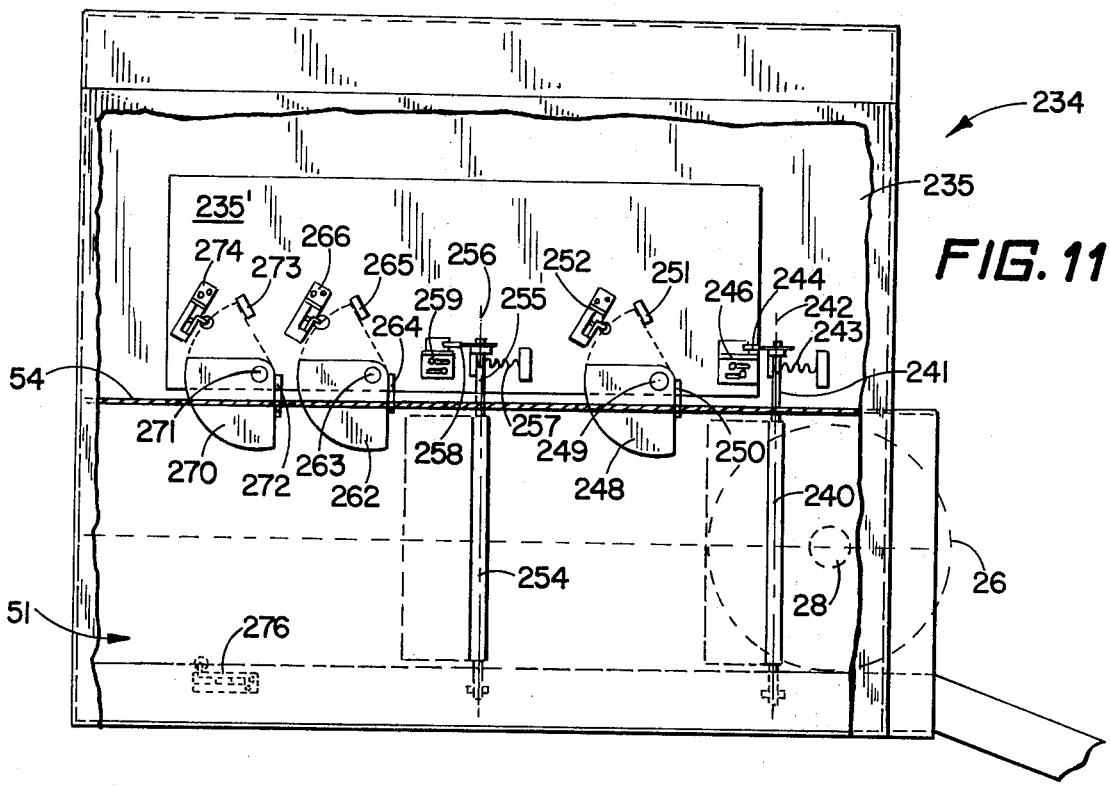
FIG. 11 is a diagrammatic representation of an alternate embodiment of the receiver apparatus of the vending system disclosed in FIG. 1, illustrating the relative positioning of its electromechanical elements.
Figure 12:
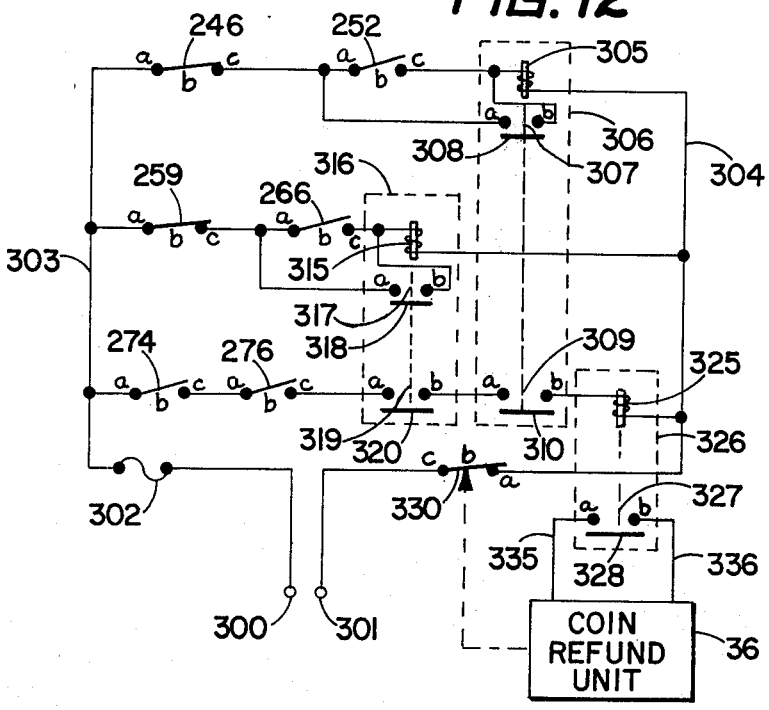
FIG. 12 is a schematic representation of the electrical control elements of the receiver apparatus disclosed in FIG. 11.

An electromechanical alternate embodiment of the receiver apparatus 234 embodying electromechanical principles is illustrated in FIGS. 11 and 12. Referring to FIGS. 11 and 12, FIG. 11 diagrammatically illustrates the relative physical positioning of the electromechanical elements of the receiver apparatus 234. FIG. 12 is a schematic representation of the electrical circuit comprising those elements illustrated in FIG. 11.

Referring to FIG. 11, there is generally shown a housing 235 having a mounting plate 235' to which the electromechanical elements of the receiver apparatus 234 are connected. The alternate receiver apparatus 234 is a physical and functional dual of the receiver apparatus 34 of the preferred embodiment previously described. The receiver apparatus 234 of FIG. 11 is viewed as it would appear if the front panel thereof (FIG. 1) were removed. The electromechanical elements of the receiver apparatus 234 appear as they would be positonally located with respect to the inverted U-shaped retaining member 54 and the upper surface of the outer race 51 of the platform 21. A support wheel 26 of a cart is illustrated in dashed lines as it would typically appear when proceeding down the outer race.

Referring to FIG. 11, a first door member 240 is mounted on a shaft 241 which is connected to the housing 235 for rotation about a vertical axis 242. The first door member 240 generally extends transversely across the path to be followed by the support wheel 26 of a cart 24 when proceeding in a receiving direction down the outer race 51. The first door member 240 is normally held in a "closed" position (illustrated in end view by solid lines) yieldingly blocking the motion of a support wheel 26 proceeding in the receiving direction by means of a bias spring 243 connected between the door 240 and the housing 235. A lever 244 is rigidly attached to the upper end of the shaft 241 and is rotatable therewith about the vertical axis 242. The lever 244 is positioned to engage a toggle arm of a first microswitch 246 whenever the door 240 is urged in an "open" position (illustrated by dashed lines). The first microswitch 246 is normally operative in a conducting mode; the engagement of the lever 244 with the first microswitch 246 upon opening of the door 240 causes the microswitch 246 to become operative in its non-conducting mode.

A first cam 248 is pivotally connected to the mounting plate 235' at a pivot point 249. The cam 248 extends through an opening formed in the top surface of the retaining member 54 and is positionally aligned with the outer race 51 so as to pivotally engage a support wheel 26 moving in a receiving direction down the outer race 51. The first cam 248 is illustrated in solid lines in FIG. 11 in its normal position at rest against a first stop member 250 and is illustrated in dashed lines in engagement with a second stop member 251 as it would appear when rotated to its maximum clockwise rotational position when engaged by a support wheel 26.

When caused to pivot in the clockwise direction, the cam 248 will operatively engage the trigger arm of a second microswitch 252. The second microswitch 252 is normally operative in a nonconducting mode, and becomes operable in its conducting mode upon activation by the first cam 248. The first cam 248 and the second microswitch 252 are relatively positioned with respect to one another and with respect to the upper surface of the outer race 51 such that the cam 248 will not actuate the microswitch 252 to its conducting mode until the axle 28 of the support wheel 26 has passed a predetermined position in the receiving direction beyond the pivot point 249 of the cam 248. The cam 248 and the microswitch 252 are also longitudinally spaced a predetermined distance in the receiving direction from the vertical axis 242, permitting the cam 248 to toggle the second microswitch 252 in its conductive mode only after the door has resumed its closed position following the complete acceptance of a support wheel into the receiver apparatus 234. Further, the cam 248 is designed, as are all the other cams to be hereinafter described, such that once the support wheel 26 has cleared the cam 248 in the receiving direction so as to allow the cam to drop back to its normal position, in engagement with the first stop member 250, the cam thereafter will prevent the support wheel 26 from being retracted from the receiving apparatus 234 in a nonreceiving direction.

A second door member 254 is mounted on a shaft 255 which is connected to the housing 235 for rotation about a vertical axis 256. The second door member 254, and the shaft 255 are similar in construction and function to the first door 240 and its mounting shaft 241. The second door 254 is held in a normally closed position by means of a bias spring 257 connected between the door 254 and the housing 235. A lever 258 is rigidly attached at the top end of the shaft 255 and is rotatable therewith about the vertical axis 256. The lever 258 is positioned to operatively engage the toggle arm of a third microswitch 259 in a manner similar to that described with respect to the lever 244 and the first microswitch 246. The microswitch 259 is normally operative in a conductive mode when the second door 254 is in its closed position. When toggled by the lever 258, the microswitch 259 becomes operative in its nonconducting mode.

A second cam 262 is pivotally connected to the mounting plate 235' at a pivot point 263. The cam 262 is illustrated in sold line in its normal position at rest against a first stop member 264, and is illustrated in dashed lines in engagement with a second stop member 265 as it would appear when rotated to its maximum rotational position when engaged by a support wheel 26. The second cam 262 is operatively rotatable in the clockwise direction to engage a toggle arm of a fourth microswitch 266. The cam 262 and the microswitch 266 are identical in construction, relative positioning with respect to each other and operation as was previously described with respect to the first cam 248 and the second microswitch 252. Further, the relative positioning of the cam 262 with respect to the vertical axis 256 is operatively similar to that previously described with respect to the first cam 248 and the vertical axis 242.

A third cam 270 is pivotally connected about a pivot point 271 to the mounting plate 235'. The cam 270 is illustrated in solid line in its normal position at rest against a first stop member 272, and is illustrated in dashed lines in engagement with a second stop member 273 as it would appear when rotated to its maximum rotational position when engaged by a support wheel 26. The cam 270 is operatively rotatable in a clockwise direction to toggle the toggle arm of a fifth microswitch 274 relatively operatively positioned therewith in a manner similar to that previously described with respect to the fourth microswitch 266 and the second cam 262. The microswitch 274 is normally operative in a nonconducting mode, and becomes operative in a conducting mode when toggled by the third cam 270.

A sixth microswitch 276 is mounted in the upper surface of the outer race 51 with its toggle arm projecting above that surface such that a support wheel 26 passing thereover will activate the switch 276 as long as the support wheel 26 remains in contact therewith. The microswitch 276 is normally operative in a nonconducting state, and becomes operative in a conducting state when activated by support wheel 26.

The fifth and sixth microswitches 274 and 276 respectively are relatively positioned with respect to one another such that a support wheel 26 proceeding down the outer race 51 in the receiving direction will simultaneously cause them to be toggled from their nonconducting to their conducting modes.

FIG. 12 is a schematic diagram of a circuit incorporating the microswitches of the receiver apparatus 234 to provide a refund signal to the coin refund unit 36. Referring to FIG. 12, there are generally shown a pair of terminals 300 and 301 adapted for connection to a power supply (not shown) for providing power to the circuit elements illustrated. The terminal 300 is generally connected to a positive source of power, and the terminal 301 is connected to a suitable ground. The positive terminal 300 is connected by means of a fuse 302 to a positive bus 303.

The positive bus 303 is directly connected to a first stationary contact 246(*a*) of the first microswitch 246. The microswitch 246 further has a movable contact 246(*b*) and a second stationary contact 246(*c*). The movable contact 246(*b*) is normally positioned in a closed position, closing the circuit between the first and second stationary contacts 246(*a*) and 246(*c*).

The second stationary contact 246(*c*) of the microswitch 246 is directly connected to a first stationary contact 252(*a*) of the second microswitch 252. The microswitch 252 further has a normally open movable contact 252(*b*) and a second stationary contact 252(*c*).

The second stationary contact 252(*c*) of switch 252 is connected by means of an energizing coil 305 of a first dual contact relay 306 to a negative bus 304. The relay 306 has a first set of stationary contacts 307(*a*) and 307(*b*) and a movable contact 308 associated therewith. The relay 306 further has a second set of stationary contacts 309(*a*) and 309(*b*) and a movable contact 310 associated therewith. The movable contacts 308 and 310 of the relay 306 are normally positioned in an electrically open position when the coil 305 is deenergized, and are movable to close the electrical circuits between their respective associated stationary contacts 307 and 309 when the coil 305 is energized.

The second stationary contact 246(*c*) of the switch 246 is directly connected to the stationary contact 307(*a*) of the relay 306. The second stationary contact 252(*c*) of the microswitch 252 is directly connected to the stationary contact 307(*b*) of the relay 306. The first set of stationary contacts 307 and the movable contact 308 of the relay 306 provide a holding circuit, bypassing the switch 252 for energizing the coil 305 of the relay 306.

The positive bus 303 is also directly connected to a first stationary contact 259(*a*) of the third microswitch 259. The switch 259 further has a movable contact 259(*b*) and a second stationary contact 259(*c*). The movable contact 259(*b*) is normally positioned in a closed position, electrically completing the circuit between the first and second stationary contacts 259(*a*) and 259(*c*).

The second stationary contact 259(*c*) of the switch 259 is directly connected to a first stationary contact 266(*a*) of the fourth microswitch 266. The switch 266 further has a normally open movable contact 266(*b*) and a second stationary contact 266(*c*).

The second stationary contact 266(*c*) of switch 266 is connected by means of an energizing coil 315 of a second dual contact relay 316 to the negative bus 304. The relay 316 has a first set of stationary contacts 317(*a*) and 317(*b*) and a movable contact 318 associated therewith. The relay 316 further has a second set of stationary contacts 319(*a*) and 319(*b*) and a movable contact 320 associated therewith. The movable contacts 318 and 320 of the relay 316 are normally positioned to form an electrical open between their associated stationary contact pairs when the coil 315 is deenergized. When the coil 315 is energized, the movable contacts 318 and 320 electrically close the circuits between their associated stationary contact pairs 317 and 319 respectively.

The second stationary contact 259(*c*) of the switch 259 is directly connected to the stationary contact 371(*a*) of the relay 316. The second stationary contact 266(*c*) of the switch 266 is directly connected to the stationary contact 317(*b*) of the relay 316. The first stationary contact pair 317 and their associated movable contact 318 of the relay 316 provide a holding circuit, bypassing the switch 266 for energizing the coil 315 of the relay 316.

The positive bus 303 is further directly connected to a first stationary contact 274(*a*) of the fifth microswitch 274. The microswitch 274 further has a normally open movable contact 274(*b*) and a second stationary contact 274(*c*). The second stationary contact 274(*c*) is directly connected to a first stationary contact 276(*a*) of the sixth microswitch 276. The switch 276 further has a normally open movable contact 276(*b*) and a second stationary contact 276(*c*).

The second stationary contact 276(*c*) of the switch 276 is directly connected to the stationary contact 319(*a*) of the second relay 316. The stationary contact 319(*b*) of the relay 316 is directly connected to the stationary contact 309(*a*) of the first relay 306.

The stationary contact 309(*b*) of the relay 306 is connected by means of an energizing coil 325 of a third relay 326 to the negative bus 304. The relay 326 further has a pair of stationary contacts 327(*a*) and a movable contact 328 associated therewith. The movable contact 328 of the relay 326 is normally positioned in an electrically open position with respect to the stationary contacts 327 when the coil 325 is deenergized, and is movable to an electrically closed position with respect to the contacts 327 when the coil 325 is energized.

The negative bus 304 is directly connected to a first stationary contact 330(*a*) of a switch 330. The switch 330 further has a movable contact 330(*b*) and a second stationary contact 330(*c*). The movable contact 330(*b*) is normally positioned in an electrically closed position between the stationary contacts 330(*a*) and 330(*c*). The second stationary contact 330(*c*) is directly connected to the common terminal 301.

The first stationary contact 327(*a*) of the relay 326 is connected by means of a first signal flow path 335 to the coin refund unit 36. The second stationary contact 327(*b*) of the relay 326 is connected by means of a second signal flow path 336 to the coin refund unit 36. The coin refund unit 36 is mechanically operative to control the operative position of the movable contact 330(*b*) of the switch 330 as illustrated by the dashed line therebetween in FIG. 12.

OPERATION OF THE PREFERRED EMBODIMENT

The automatic cart vending system 20 (FIG. 1) of this invention is generally operable to receive a plurality of carts 24 to the platform 21, to retainably hold the carts in consecutive alignment thereon, and to dispense the carts from the platform. The support wheels 26 and 27 of the carts 24 ride in the outer and inner races 51 and 50 respectively of the platform 21 and guide the carts therealong. The retaining members 54 positioned over the axially aligned support wheels 26 prevent lifting and twisting of the carts 24 on the platform 21, thereby preventing their removal other than at the dispensing terminal 42.

In general, an operator adds a cart to the platform 21 by continously rolling the cart from the floor 22, up the entrance ramp 33, and by guidingly positioning the support wheels 26 within the outer races 51. Upon urging the forward support wheel 26 of the cart in the receiving direction (from right to left in FIG. 1) through the receiver apparatus 34, the coin refund unit 36 operatively connected therewith returns a predetermined amount of change at its coin chute 37. An operator removes a cart from the platform 21 by depositing the correct amount of change in the monetary actuated control unit, thus activating the dispenser apparatus 44 and by urging the rearward wheel 26 of the foremost cart in the dispensing direction (from right to left in FIG. 1) through the dispenser apparatus 44 and down the exit ramp 43 to the floor 22.

The sequential operation of the dispenser apparatus 44 is illustrated in detail in FIGS. 3–6. FIG. 3 illustrates the relative positioning of the dispenser apparatus 44 elements as they would appear at the beginning of, and following the completion of the preceding dispensing cycle. The release member 60 is maintained in a first rest position against the stop member 73 by the bias spring 72 and the force of the bias spring 95 acting through the arm 94 of the second actuator member 90 and the rod 69. The tension of the actuator cable 100 is adjusted within the monetary actuated control unit 46 to oppose the bias of the spring 98 such that the actuator rod 96 is freely maintained within the notch 93 of the arm 92 of the second actuator member 90. Therefore, the first actuator member 76 and the second actuator member 90 connected thereto are free to rotate about the pivot point 77, and are urged in counterclockwise rotation thereabout by the spring 80 such that the stop surface 79 of the first arm 78 of the first actuator member 76 is in resting engagement with the stop member 73. The trip lever 104, positioned as illustrated, does not prevent the first actuator member from engaging the stop member 73, as a result of occurrences, to be hereinafter described, of the last preceding dispensing cycle. The pawl 84 (FIG. 6) engages the ratchet teeth 67 of the release member 60 under the influence of the bias spring 86, locking the release member 60 against the stop member 73. The plate 66 and rod 65 connected to the second downwardly depending arm 64 of the release member 60 prevent the release of a support wheel 26 from the dispensing apparatus. Any attempt to force the wheel 26 through the dispenser apparatus 44 may result in a partial collapsement of the wheel 26; however, when positioned as in FIG. 3, the lower end of the plate 66 is well below the total collapse point of the wheel 26 and prevents the wheel from being forced thereunder in the dispensing direction.

As an operator activates the monetary actuated control unit by depositing the correct change in escrow therein, the actuator cable 100 is operatively engaged within the monetary control unit 46 and is pulled into the monetary actuated control unit against the force of the spring 98. In the preferred embodiment, a mechanical monetary actuated control unit is employed, and the energy required for exerting the force upon the actuator cable 100 is supplied by the operator when he deposits the correct change into the monetary control unit 46 by sliding the coil accepter lever 47 into and out of the monetary control unit 46. Referring to FIGS. 3 and 4, the actuator rod 96 is therefore caused to rotate in a counterclockwise direction about the pivot point 97 and forceably engages the notch 93 of the first arm 92 of the second actuator member 90. Continued movement (to the lower right in FIG. 3) of the actuator cable 100 causes the actuator rod 96 to rotate the first actuator member 76 in a clockwise direction about its pivot point 77 by means of the second actuator member 90. As the first actuator member 76 rotates in the clockwise direction, the trip lever 104 is enabled to rotate in the clockwise direction about its pivot point 105 under the influence of the spring 110 until its first arm 106 is enabled to snap into engagement with the lower surface of the first arm 78 of the first actuator member 76 (see FIG. 4). The clockwise rotation of the first actuator member 76 releases the pawl 84 from engagement with the ratchet teeth 67 of the release member 60, thereby enabling the release member 60 to be rotated in the clockwise direction about its pivot point 61. FIG. 4 illustrates the relative positioning of the elements of the dispenser apparatus 44 upon the completion of the enabling portion of the dispensing cycle above described. Upon completion of the enabling portion of the dispensing cycle, the tension in the actuator cable 100 is normally relaxed to that tension it had thereon immediately preceding the enabling portion of the cycle.

Having completed the enabling portion of the dispensing cycle, an operator is enabled to push a cart 24 from the vending island by urging its rearward wheel 26 in the dispensing direction through the dispenser apparatus 44. The actual dispensing of a cart wheel 26 is described with reference to FIGS. 4 and 5. As an operator urges the support wheel 26 in the dispensing direction, the wheel engages the rod 65 and plate 66 connected to the arm 64 of the release member 60. The release member 60 is caused to rotate in a clockwise direction about the pivot point 61 against the bias of the spring 72, the spring 80 and the force of the spring 95 transmitted through the second actuator member 90 and the rod 69. As the wheel 26 urges the arm 64 of the release member 60 in an upward direction, the arm 62 of the release member 60 will simultaneously be urged in a downward direction with the rod 63 connected thereto blocking the motion in the receiving direction of the consecutively aligned support wheel 26. The release member 60 rotates clockwise until it engages the second stop member 74, at which point the plate 66 will be generally parallel with the top surface of the outer race 51 and the vertical distance therebetween will be sufficient to enable the foremost support wheel 26 to pass therebetween. The release member 60 will remain in this second position until the support wheel being dispensed has cleared the plate 66 (see FIG. 5). Any attempt by an operator to force two carts (support wheels) through the dispenser apparatus 44 on a single dispensing cycle will cause the release member 60 to attempt to rotate in the counterclockwise direction, thereby causing the plate 66 to assert a force on the foremost wheel retarding its motion in the dispensing direction.

As the release member 60 rotates in the clockwise direction, its cylindrical surface 68 engages the second arm 107 of the trip lever 104, causing the trip lever 104 to rotate in the counterclockwise direction about the pivot point 105. As the trip lever 104 rotates counterclockwise, the first actuator member 76 is enabled to rotate in the counterclockwise direction, under the influence of the bias spring 80, about the pivot point 77 until the stop surface 79 of the arm 78 of the first actuator member 76 re-engages the stop member 73. The spring constant of the spring 80 is significantly larger than that of the spring 110 so as to thereafter maintain the first actuator member 76 in the position illustrated in FIG. 5. The actuator elements are thus illustrated in FIG. 5 in their reset condition.

As soon as the foremost support wheel 26 clears the plate 66 in the dispensing direction, the release member 60 will, under the influence of the spring 72, the spring 80 and the force of the spring 95 transferred thereto by means of the second actuator member 90, rotate counterclockwise about its pivot point 61 to resume the position illustrated in FIG. 3. Upon such rotation, the ratchet teeth 67 of the release member 60 will re-engage the pawl 84, thus completing the dispensing cycle of resetting the dispenser apparatus 44 and preventing the release of the next consecutively aligned support wheel until the monetary actuated control unit 46 is reactivated.

In the event the monetary actuated control unit 46 should malfunction, or a cheat on the system is attempted such that the actuator cable 100 is maintained in a position that would normally enable the dispenser apparatus 44 after the vend of the first support wheel 26, the actuator rod 96 will remain in that position illustrated in FIG. 4. The movable end of the actuator rod 96 will however ride out of the notch 93 in the arm 92 of the second actuator member 90 when the first and second actuator members 76 and 90 rotate in the clockwise direction during the reset portion of the dispensing cycle, such that the end of the actuator rod 96 will rest upon the top surface of the arm 92 between the notch 93 and the pivot point 91. In this position, the actuator rod 96 will neither prevent the first actuator member 76 from rotating to its reset position (FIG. 5) nor the release member 60 from rotating in a counterclockwise direction to its reset position following the vend of a wheel, but will prevent the subsequent release of the release member 60 to its second position until the monetary actuated control unit 46 has been recycled. Upon recycling of the control unit 46, the tension on the cable 100 will be relaxed, enabling the actuator rod 96 to re-engage the notch 93 in the second actuator member 90.

Since the first and second actuator members 76 and 90 respectively and the trip lever 104 are enclosed within the housing 45 of the dispenser apparatus 44, they can not be manually manipulated to enable carts to be vended from the system by bypassing the monetary actuated control unit 46. Further, any attempt to force a wheel back through the dispenser apparatus 44 in a direction opposite to the dispensing direction is prevented by means of the plate 66.

Near optimum operation of the release mechanism portion of the dispenser apparatus 44 is provided by configuring the release member 60 to correspond to a specific size of a support wheel. In particular, the proper balance between relative operator ease in dispensing a cart and effective theft prevention protection is provided by designing and positioning the release member 60 such that when in its second position illustrated in FIG. 5, the pivot point 61, the center line of the rod 63 and the axle of that support wheel 26 tangentially engaging the rod 63 are generally colinear.

A cart is added to the platform 21 at the receiving teminal 32 of the vending island 20. An operator rolls the cart from the floor 22 up the entrance ramp 33, engaging the forward support wheel with the receiver apparatus 34. Various relative positions of the receiver apparatus elements of the preferred embodiment during a receiving cycle are illustrated in FIGS. 7 through 9.

Referring to FIG. 7, the receiver apparatus elements 34 are illustrated in solid line as they would appear in their resting position when awaiting the receipt of a support wheel 26. The door 115 is held in a closed position by the bias spring 118, causing the retaining member 119 to engage and hold the latching lever 141 in a generally vertical position as illustrated. The accepter member 122 is held in its receiving position, enabling a support wheel 26 to pass beneath the arm 124 and connecting rod 126, by means of the bias spring 128 and by means of the force of the spring 138 acting through the first actuator lever 132 and the set screw 134. In the preferred embodiment, the coin refund unit 36 maintains a slight tension upon the coin refund cable 160. The coin refund unit 36 is responsive to a sudden impulsive force exerted on the cable 160 in the downward direction. The second actuator lever 145 is cocked about its pivot point 146 by the spring 147 and restingly engages the third actuator lever 152. The third actuator lever 152 is held in a nearly vertical position as illustrated by means of the bias spring 153. The third actuator lever 152 is shown at its position of maximum counterclockwise rotation about its pivot point 154. The extended member 155, the rod 157 and the extended plate 158 are illustrated as they would typically appear when freely hanging from the pivot point 156. The extended member 155, its connected rod 157 and extended plate 158 are free to rotate in the counterclockwise direction about the pivot point 156, but can not rotate in the clockwise direction beyond that point wherein the extended member 155 and the third actuator lever 152 are aligned (as illustrated in FIGS. 8 and 9).

When a support wheel 26 is urged into the receiving apparatus 34, the door member 115 rotates to an open position about the axis 117 (illustrated in dashed lines in FIG. 7) allowing the retaining member 119 pivoting therewith to release its retaining force on the latching lever 141. The latching lever 141 is therefore urged by means of the spring 140 into counterclockwise rotation about its pivot point 142 until the notch in its rotating end engages the first contact surface 135 of the first actuator lever 132. The first actuator lever 132 and thus the accepter member 122 are thereafter prevented from rotating in the clockwise direction about their respective pivot points 133 and 123 as long as the latching lever 141 engages the first actuator lever 132. This condition occurs as long as the door member 115 is held in an open position. When the support wheel 26 has cleared, in the receiving direction (from right to left), the door member 115, the door 115 will normally be urged to reclose by means of the spring 118. If, however, the support wheel 26 has cleared the door 115 but the door is retained in an open position by an operator's hand or other device, the receiver apparatus will be locked as previously described by means of the latching lever 141.

When the door member 115 is allowed to re-close upon the acceptance of a support wheel 26 into the receiver apparatus 34, the support wheel 26 will engage the rod 127 connected to the arm 125 of the accepter member 122, urging the accepter member 122 to rotate in a clockwise direction against the bias of the spring 128. the rotating accepter member 122 will also cause the first actuator lever 132 to rotate in a clockwise direction about the pivot point 133 and against the bias of the spring 135 as illustrated in FIG. 8, enabling the coin refund actuator cable 160 to be retracted into the coin refund unit 36. The second contact surface 136 of the first actuator lever 132 slidably engages the second actuator lever 145 until the first actuator lever 132 has sufficiently rotated in the clockwise direction to enable the second contact surface 136 to drop into the notch 148 of the second actuator lever 145. This occurs when the support wheel 26 has proceeded in the receiving direction to that point illustrated in FIG. 8. The set screw 134 in the first actuator lever 132 can be adjusted to vary that rotational position of the accepter member 122 at which the first actuator lever 132 will engage the notch 148. The depth of the notch 148 of the second actuator lever 145 is varied by means of the set screw 149.

Once the second contact surface 136 of the first actuator lever 132 has dropped into the notch 148, it will be retainably held in that latched position within the notch by means of the spring 135, with the second actuator lever being securely held against the second contact surface 136 of the first actuator lever 132 by means of the bias spring 147. When the support wheel 26 has proceeded to that position illustrated in FIG. 8, and the second contact surface 136 of the first actuator lever 132 has engaged the notch 148 of the second actuator lever 145, the receiver apparatus is enabled to provide a coin refund signal to the coin refund unit 36.

As the support wheel 26 is urged further in the receiving direction down the outer race 51, the extended member 155, the rod 157 and the extended plate 158 are urged in clockwise rotation about the pivot point 156 to their locked position with respect to the third actuator lever 152. Further movement of the support wheel 26 in the receiving direction will cause the third actuator lever 152 to rotate clockwise about the pivot point 154, thus extending the spring 153 and increasing the latching force between the first and second actuator levers 132 and 145 respectively.

When the support wheel 26 has cleared the rod 127 connected to the arm 125 of the accepter member 122, the accepter member 122 will rotate counterclockwise to its receiving position under the influence of the spring 128. It will be noted that the housing connection for the spring 138 also forms a stop member for limiting the counterclockwise rotation of the accepter member 122 about its pivot point 123.

As the support wheel 26 proceeds in the receiving direction so as to clear the plate 158, the third actuator lever 152 will rapidly rotate in the counterclockwise direction about the pivot point 154 under the influence of the extended spring 153, causing the lever 152 to impart an impulsive force upon the lower terminus of the second actuator lever 145. This impulsive force causes the second actuator lever 145 to rotate counterclockwise about the pivot point 146 and against the bias of the spring 147, thus disengaging the second contact surface 136 of the first actuator lever 132 from the notch 148. The first actuator lever 132 thereafter rotates counterclockwise about its pivot point 133 under the influence of the spring 138, giving a sudden impulsive downward jerk to the coin refund actuator cable 160. The impulsive force (coin refund signal) on the cable 160 enables the coin refund unit 36 to refund a predetermined amount of change to the operator. The sensitivity of that force required to unseat the second contact surface 136 of the first actuator lever 132 from the notch 148 is adjustable by means of the set screw 149 varying the effective depth of the notch by counterclockwise rotation of the second actuator lever required to unseat the first actuator lever 132.

When the support wheel 26 has proceeded in the receiving direction past the extended plate 158 so as to effect a coin refund, the support wheel 26 is irreversibly received to the platform and can not thereafter be pulled in the nonreceiving direction back through the receiver apparatus. If an attempt is made to retract the support wheel 26 back through the receiver apparatus, the extended member 155, the rod 157 and the extended plate 158 will pivot in a counterclockwise direction about the pivot point 156, until the extended plate 158 comes in resting engagement with the rod 127 connected to the arm 125 of the actuator member 122. The length of the arm 125 and its relative positioning with respect to the wheel 26 is such that when the plate 158 is positioned against it as above described, the force exerted by the support wheel 26 upon the accepter member 122 will tend to urge the accepter member 122 in counterclockwise direction about its pivot point 123, thus negating any attempt to retract the wheel. Further, any such attempt will not reset the coin refund enable condition by placing the second actuator lever into its latched position with respect to the second actuator lever 145.

Any attempt to trigger the coin refund mechanism by hand from the non-door end of the receiver apparatus is virtually impossible, since to do so would require one to insert his arm beneath the extended plate 158 and to physically force the accepter member 122 in clockwise rotation so as to latch the first actuator lever 132 with the second acutator lever 145. The force exerted upon the accepter member 122 by the spring 128 and by means of the force from the spring 138 acting through the first actuator lever 132 is strong enough so as to make such manual manipulation virtually impossible.

Operation of the alternate embodiment of the receiver apparatus 234 employing electromechanical principles is illustrated with reference to FIGS. 11 and 12. Referring thereto, the alternate receiver apparatus requires that a support wheel 26 being received proceed along the outer race 51 in the receiving direction simultaneously operating a predetermined sequential series of electromechanical elements before the predetermined monetary amount will be refunded by the coin refund unit 36.

A support wheel 26 proceeding in the receiving direction will initially engage the first door 240 causing it to rotate in an opening direction about its pivot axis 242, and causing the lever 244 rotating therewith to toggle the movable contact 246(*c*) of the switch 246 to an open position. As long as the door 240 remains in an open position, the relay 306 is deenergized by the switch 246, and a coin refund signal cannot be delivered to the coin refund unit 36.

The support wheel 26 proceeding in the receiving direction, will next engage the first cam 248 causing it to rotate clockwise about its pivot point 249 and to toggle the movable contact 252(*b*) of the switch 252 to its electrically closed position. The cam 248 and the microswitch 252 are positionally configured with respect to the door 240 such that the support wheel 26 clears the door 240 while maintaining the electrically closed condition of switch 252. As soon as the door 240 retains its closed position, signifying the irreversible acceptance of the support wheel 26 by the receiver apparatus 234, the lever 244 operatively disengages the microswitch 246, enabling its movable contact 246(*b*) to resume its normally closed position, and completing the electrical circuit through the switches 246 and 252 to energize the coil 305 of the relay 306.

Upon energization, the coil 305 of the relay 306 urges its movable contacts 308 and 310 into electrically closed engagement respectively with the contact pairs 307 and 309. The closed contact pair represented by the stationary contacts 307 and the movable contact 308 completes a holding energization circuit for the coil 305, effectively thereafter bypassing the switch 252. Should, however, the door 240 be re-opened (for example by hand) the switch 246 will electrically reopen, once again deenergizing the relay 306. When the support wheel 26 has cleared the cam 248, the cam 248 will rotate counterclockwise back to its original position. As previously described, the cam 248 is designed such that an attempt to retract the support wheel 26 in the non-receiving direction is prevented by the cam 248 and the stop member 250.

In similar manner, upon proceeding in the receiving direction, the support wheel 26 will next urge the second door 254 to open, electrically opening the switch 259 and maintaining the relay 316 in a deenergized state. The support wheel 26 will thereafter engage the cam 262 causing it to rotate clockwise about its pivot point 263 thus electrically closing the switch 266. When the support wheel 26 has cleared the door 254 so as to allow it to re-close, an electrical circuit will momentarily be completed from the positive supply by means of the switches 259 and 266 to energize the coil 315 of the relay 316. When energized, the coil 315 of the relay 316 wil cause the movable contacts 318 and 320 associated with the stationary contact pairs 317 and 319 respectively to close. The contact pair 317 when closed by the movable contact 318 will complete a holding circuit bypassing the switch 266 for the coil 315 as long as the second door 254 is not subsequently re-opened. Up to this point in time, therefore, the electrical path from the positive supply to the energizing coil 325 of the relay 326 is closed except for the open switches 274 and 276.

As the support wheel further proceeds in the receiving direction it will simultaneously engage the cam 270, causing it to rotate clockwise about the pivot point 271 and thus electrically closing the switch 274, and the movable contact 276(*b*) of the switch 276 in the race 51. The electrical circuit to energize the coil 325 of the relay 326 is thus momentarily complete by means of the switches 274 and 276 and the relay contact pairs 319/320 and 309/310. When energized, the coil 325 of the relay 326 will cause its movable contact 328 to electrically close the circuit between the contact pair 327, thus providing a coin refund signal to the coin refund unit 36 by means of the signal flow paths 335 and 336.

The coin refund unit thereafter completes the refund of a predetermined monetary amount to the operator and in so doing provides a mechanical signal to the movable contact 330(*b*) of the switch 330 for opening the electrical return path for and denergizing the relays 306, 316 and 326. The circuit is therefore reset for another refund cycle.

It will be noted that each of the cams 248, 262 and 270 operate in similar fashion to prevent a retraction of the support wheel 26 in the non-receiving direction once that wheel has cleared that cam. Further, the first and second doors 240 and 254 also prevent a retraction of the support wheel in a nonreceiving direction.

While I have disclosed a specific embodiment of my invention, it is to be understood that this is for the purpose of illustration only, and that my invention is to be limited solely by the scope of the appended claims.

What is claimed is:

1. An improved dispenser apparatus for use in combination with a vehicle vending system of the type characterized by retaining means for retaining a plurality of vehicles each having a chassis carried by a plurality of normally floor-engaging support wheels a dispensing terminal from which the vehicles are dispensed, and monetary actuated control means for normally producing a first vend signal and for producing a second vend signal different from the first vend signal upon receipt thereby of a predetermined monetary amount, said dispenser apparatus comprising:

a. wheel control means operatively connected at the dispensing terminal configured to engage one of the floor-engaging support wheels of that retained vehicle disposed immediately adjacent the dispensing terminal for directly controlling movement of the engaged wheel in a dispensing direction, said wheel control means including a wheel release member operable between first and second positions and mounted for engagingly applying movement controlling forces directly to the circumferential tread portion of the engaged support wheel, said wheel release member being operable in its first position to engage the support wheel so as to directly block movement thereof in said dispensing direction and being yieldingly movable to its said second position in response to forces exerted thereon by the engaged support wheel to enable movement of the engaged support wheel relative thereto in said dispensing direction; and b. dispenser actuator means operatively connected to receive firsts and second vend signals for activating in response thereto said wheel control means to selectively block and enable dispensing movement of the engaged support wheel, comprising:

i. pawl and ratchet latching means cooperatively engaging said wheel release member for controlling movement thereof between its said first and said second positions, said pawl and ratchet latching means being operable in a latched mode to engagable lock said wheel release member in its said first position, preventing movement thereof toward its said second position, and being operable in an unlatched mode to release locking engagement of said wheel release member, enabling movement thereof between its said first and said second positions; and ii. a plurality of actuator members connected to receive the vend signals and being cooperatively responsive thereto for selectively controlling the operative mode of said pawl and ratchet latching means, said actuator members being cooperatively engageable upon receipt of a first vend signal to actuate said pawl and ratchet latching means for operative engagement in its said latched mode, and being cooperatively engagable upon receipt of a second vend signal to activate said pawl and ratchet latching means for operative engagement in its said unlatched mode.

2. An improved dispenser apparatus according to claim 1, wherein said pawl and ratchet latching means comprises:

a. a plurality of ratchet teeth fixedly connected to and movable with said wheel release member;

b. pawl means operatively connected with at least one of said plurality of actuator members and cooperatively engagable with said ratchet teeth for directly controlling movement of said teeth relative thereto; said pawl means being operable when in said latched mode to engage said ratchet teeth so as to enable movement of said teeth relative thereto as said wheel release member moves toward its said first position and to block movement of said ratchet teeth relative thereto when said wheel release member tends toward movement to said second position, and being operable when in said unlatched mode to disengage said ratchet teeth to enable unrestricted movement of said ratchet teeth and wheel release member relative thereto.

3. An improved dispenser apparatus according to claim 1, wherein said dispenser actuator means includes mechanical override means operatively connected with said plurality of actuator members, engagable by said wheel release member and responsive to movement thereof from its said first position to its said second position, for activating said pawl and ratchet latching means so as to become operable in its latched mode whenever said wheel release means is disposed in said second position and for overriding the normal effect of transmission of any second vend signal to said actuator members.

4. An improved dispenser apparatus according to claim 3, wherein said plurality of actuator members comprise:

a. a first actuating lever pivotally connected to said pawl and ratchet latching means, normally biased toward rest in a first position enabling operative engagement of said pawl and ratchet latching means in its said latched mode, and being pivotally movable to a second position causing operation of said pawl and ratchet latching means in said unlatched mode;

b. a second actuating lever pivotally connected for movement with said first actuating lever, normally biased toward a first position urging said first actuating lever toward its said first position and being pivotally movable to a second position urging said second actuating lever toward its said second position; and c. a third actuating lever connected to received said first and said second vend signals and engagable with said second actuating lever, normally biased in a first position when in receipt of said first vend signal to engagably urge said second actuating lever toward its said first position and being pivotally movable toward a second position responsive to receipt of said second vend signal to engagably move said second actuating lever toward its said second position; and wherein said override means includes:

a. a fourth lever arm connected to said second actuating lever and operatively engagable by and responsive to movement of said wheel release member from its said first position to its said second position pivotally moving said second actuating lever to a third position so as to operatively disengage said third actuating lever when said wheel release member is in its said second position, and being responsive to movement of said wheel release member to its said first position to engagably return said second actuating lever for normal operation between its said first and said second positions; and b. a trip lever operatively connected with said pawl and ratchet latching means and engagable by said wheel release member when moving to its said second position, said trip lever being operative in a first position to maintain said pawl and ratchet latching means in its said unlatched mode when said wheel release member is positioned in its said first position, and being operative in a second position to cause engagement of said pawl and ratchet latching means in its said latched mode whenever said wheel release member is positioned in its said second position.

5. An improved dispenser apparatus according to claim 1, wherein said wheel control means includes a wheel restraint member connected for cooperative reciprocal movement with said wheel release member between blocking position and a neutral position, for controlling movement in said dispensing direction of a floor-engaging support wheel of that one of the retained vehicle consecutively aligned with that vehicle to be next dispensed, said wheel restraint member being operable in its said blocking position in response to movement of said wheel release member to its said second position to directly engage the outer peripheral surface of said consecutively aligned support wheel for preventing movement thereof in said dispensing direction, and being operable in its said neutral position responsive to movement of said wheel release member to its said first position for enabling unrestrained movement of said consecutively aligned support wheel with respect thereto.

6. An improved receiver apparatus for use in combination with a vehicle vending system fo the type characterized by retaining means for retaining a plurality of vehicles each having a chassis carried by a plurality of normally floor-engaging support wheels, a receiving terminal opening into the retaining means through which the vehicles are retainably accepted by the retaining means, and monetary refund means for discharging a predetermined monetary amount in response to a received refund signal, said receiver apparatus comprising:

a. a housing configured for mounting at the receiving terminal in cooperative alignment with said retaining means, said housing defining a substantially enclosed inner cavity and oppositely longitudinally disposed inlet and outlet ports providing access to and egress from the internal cavity, said housing being configured to substantially enclosedly accept within its said cavity at least one floor-engaging wheel of a wheeled vehicle being received by the vending system;

b. a door pivotally mounted to said housing adjacent said inlet port thereof, said door member being normally disposed in a closed position to substantially close access to said internal cavity through said inlet port and being pivotally movable to an open position to provide passage of a floor-engaging support wheel into said cavity through said inlet port;

c. a first actuator lever in said housing operatively connected with the monetary refund means and pivotally movable between first and second positions, said first actuator lever being operable to provide a refund signal to the refund means in response to movement between its said second and said first positions respectively;

d. first bias means for normally biasing said first actuator lever toward its said first position;

e. first latching means in said housing cooperatively engaging said first actuator lever and responsive to movement of said door member for selectively controlling movement of said first actuator lever, said first latching means being normally operative in an unlatched mode to allow unimpeded movement of said first actuator lever to its said second position, and being operable in a latched mode in response to movement of said door member from its said closed to said open positions to latchingly engage said first actuator lever for preventing movement thereof to its said second position;

f. second latching means in said housing cooperatively engagable with said first actuator lever for selectively controlling movement of said first actuator lever, said second latching means being normally operative to engagably latch said first actuator lever in its said second position once the first actuator lever has moved to its said second position, and being operative in an unlatched mode responsive to receipt of a trigger signal to disengage from said first actuator lever, enabling movement of said first actuator lever toward its said first position;

g. mechanical wheel position sensing means mounted in said cavity of said housing means and operatively connected with said first actuator lever, for sensing the relative position of a support wheel proceeding through said cavity in a receiving direction from said inlet port to said outlet port and for moving said first actuator lever in response thereto, said wheel position sensing means comprising:

i. a first wheel engaging member pivotally mounted in said housing to engage the peripheral tread portion of a floor-engaging support wheel therein and operatively engagable with said first actuator lever for moving said first actuator lever between its said first and said second positions in response to movement of the engaged support wheel in the receiving direction, said wheel engaging member being normally disposed in a first position across the path of the advancing wheel and being movable to a second position upon engagement forces applied by the advancing wheel when the wheel has advanced in the receiving direction to a predetermined position, said wheel engaging member when in its said second position cooperatively engaging said first actuator lever so as to move said first actuator lever to its said second position and into latching engagement with said second latching means; and ii. second bias means operatively connected with said first wheel engaging member for normally urging said wheel engaging member toward its said first positions; and h. a second actuator lever member operatively mounted in said cavity adjacent the outlet port of said housing and disposed to engage the peripheral tread portion of a support wheel passing from the internal cavity through said outlet port, said second actuator lever being pivotally operable in response to passage of the engaged support wheel through said outlet port, to apply said trigger signal to said second latching means.

7. An improved receiver apparatus as recited in claim 6, wherein said second actuator lever member is configured so as to produce only one trigger signal in response to passage of the support wheel through said outlet port in said receiving direction and is cooperatively operable with said first wheel engaging member to block retraction movement of the support wheel back into the outlet port and through said housing in a direction opposite to said receiving direction.

8. An improved receiver apparatus as recited in claim 6, wherein said first and said second actuator levers, said first and said second latching means and said mechanical wheel position sensing means are mounted within said housing in a position overlying the path of the support wheel passing through said cavity and wherein said first wheel engaging member is pivotally lifted to its said second position by means of the engagement force exerted thereon at the tread circumference of the advancing support wheel.

9. An improved receiver apparatus as recited in claim 8, wherein said housing is configured to define an internal wall member overlying the path of an advancing support wheel through said housing and defines an upper chamber within said cavity, and wherein said first and said second actuator levers, said first and said second latching means, said first and said second bias means, and said mechanical wheel engaging member are substantially enclosed within said upper chamber except for those portions thereof which are operatively engaged to an advancing support wheel, rendering the cooperative operation of these components tamper proof.

10. An improved receiver apparatus as recited in claim 8 wherein the bias force of said second bias means urging said first wheel engagement member toward its said first position is of such magnetude such that said first wheel engagement member cannot be lifted by means of normal finger pressure, and wherein said first wheel engaging member is longitudinally spaced from said inlet port of said housing at a distance at least equal to the diameter of the support wheel being received by said apparatus.

* * * * *